United States Patent [19]

Slayman

[11] 4,037,765

[45] July 26, 1977

[54] GOLF CLUB CARRIER

[76] Inventor: Mitchell Slayman, 30701 Fairgreens West, Laguna Niguel, Calif. 92677

[21] Appl. No.: 717,582

[22] Filed: Aug. 25, 1976

[51] Int. Cl.[2] ..... A45F 5/00

[52] U.S. Cl. ..... 224/25 R; 224/5 P; 280/DIG. 6; 280/1.5

[58] Field of Search ..... 224/8 A, 5 P, 5 A, 5 B, 224/5 R, 29 B, 42.42 R, 42.46 R, 42.45 R, 25 A, 25 R, 1 B, 5 V, 5 MA, 8 R, 5 M, 5 N, 5.1; 248/95, 96, 97, 98; 280/DIG. 6, 1.5, 47.13 R, 47.26; D14/3; 150/1.5 R; 40/29 A

[56] References Cited

U.S. PATENT DOCUMENTS

| | | | |
|---|---|---|---|
| 2,411,965 | 12/1946 | Hartung | 280/DIG. 6 |
| 2,621,799 | 12/1952 | Wilson | 248/96 X |
| 3,165,330 | 1/1965 | Cotton | 280/DIG. 6 |
| 3,360,279 | 12/1967 | Hunt | 280/DIG. 6 |

*Primary Examiner*—Albert J. Makay
*Assistant Examiner*—Jerold M. Forsberg
*Attorney, Agent, or Firm*—Allan Miller

[57] ABSTRACT

A rigid aluminum frame is suspended from the shoulders to support cross members to which golf clubs are releasably attached.

The user grasps the collar of the frame with one arm and bends slightly until the frame rests on both shoulders by means of two semi-circular platform supports, which ride upon the shoulders. When the user straightens his body, the clubs are lifted off the ground and are readily transported around the golf course.

3 Claims, 3 Drawing Figures

GOLF CLUB CARRIER

BACKGROUND OF THE INVENTION

There is an urgent need among golfers to have a relatively simple, convenient and inexpensive method for carrying golf clubs.

Repetitive bending and stooping to pick up a golf bag from the ground is extremely tiring, if not impossible for golfers with orthopedic problems. The weight of the bag can also cause soreness and irritation to the shoulders.

Golf carts that are hand-pulled are unsatisfactory, particularly on hilly terrain or where there are creeks or uneven ground. This tends to cause the golfer's arm or shoulder to become fatigued, which can adversely affect one's game. In addition, some golfers may not decide which club to use until they are at the tee, because of wind conditions or changes in pin location, thus requiring them to pull a cart up to an elevated tee.

A coupling apparatus to couple the golf cart to the torso of the golfer would not solve the problem, since it might lessen fatigue of the arm, but would simultaneously cause fatigue and strain of the low back muscles.

Other devices, known in the prior art for transporting goods from place to place, are releasably attached to the body. However, the overwhelming majority of these devices depend upon the use of shoulder straps, which require constant adjustment, wear out rapidly with frequent use and worst of all cause the bulk of the weight distribution to be pulling downward on the shoulders.

None of these devices known in the prior art pivot freely on the shoulders to allow for shifts in body movement and direction, which would avoid an annoying downward pulling force on the shoulders.

Moreover, other devices known in the prior art either pull on the hip, torso, low back or some other portion of the body causing soreness and irritation of the affected part.

On the contrary, the present invention distributes the weight to be carried on a rigid frame, which freely rides on the shoulder; and it is the frame which bears the weight, not any portion of the body.

The known prior art relating to carriers attached to the body includes the following U.S. Pat. Nos. 950,452; 1,302,927; 1,727,008; 2,124,265; 2,140,688; 3,328,043; and 3,856,191.

SUMMARY OF THE INVENTION

The golf club support system comprises a rigid frame, which rides on both shoulders by means of semi-circular platform supports, which enables the frame to pivot vertically and horizontally. The front most portion of the frame is shaped like a collar, which is grasped with either arm to mount the frame on the shoulder, and which further facilitates to balance changes in weight and force caused by shifts in body movement and direction.

When the frame rests on the user's shoulders, the legs 21 and 22 of the frame 20 are parallel to the sides of the user's body. Attached to the vertical members are cross members 61, 62 and 63 to which golf clubs are attached lengthwise. Upright hollow support members 71 and 72 expand outwardly to telescopically engage tubular supports to which are connected wheels for use when the carrier is being pulled or pushed along the ground.

When the frame is mounted on the user's shoulders, the wheels are off the ground.

DETAILED DESCRIPTION OF THE PREFERRED EMBODIMENT

Figure 1:
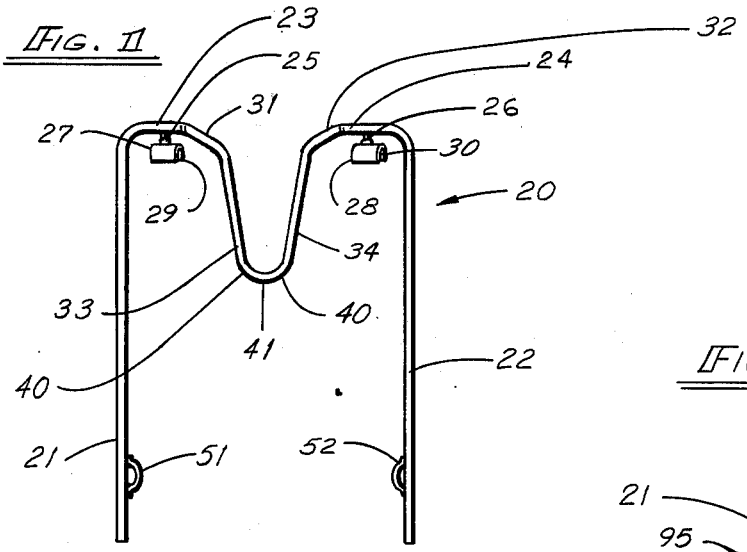
FIG. 1 is a plan view of the frame itself.

Referring to the drawings in this case, and particularly to FIG. 1, it may be seen that the invention which is a golf club support system contemplates and includes a one piece rigid frame, generally designated by reference numeral 20, principally comprising legs 21 and 22, which are substantially parallel to each other and form at their uppermost ends horizontal members 23 and 24 which would be above and substantially parallel to the shoulders of the user.

Mounted on the underside and proximate the center of the horizontal lengths of horizontal members 23 and 24 are swivels 25 and 26 to which are pivotally attached semicircular platform supports 27 and 28, which pivot freely in vertical and horizontal directions. Foam pads 29 and 30 are concentrically attached to the semicircular platform supports 27 and 28 for comfort when riding upon the shoulders of the user.

The proximate ends of horizontal members 23 and 24 are substantially perpendicular to lateral members 31 and 32 which are substantially perpendicular to the width of the shoulders and are angled outward from the chest to form substantially vertical members 33 and 34, which are also angled outward from the chest of the user and terminate in a substantially v-shaped collar 40 which at its bottom most point 41 would project outward from the chest approximately 10 or 12 inches from the chest.

The respective dimensions of all of the above-mentioned members of frame 20 are not material so long as the frame rides comfortably on the shoulders of the user with vertical members 21 and 22 disposed several inches from the outside of the user's arms to allow freedom of movement of the torso and arms.

Figure 2:
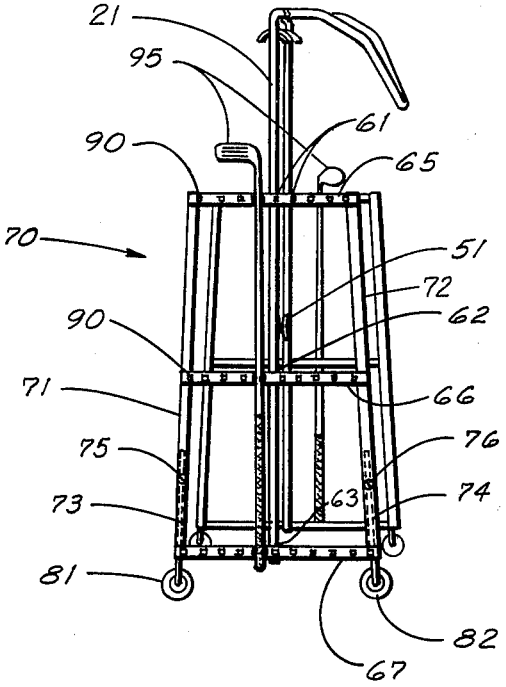
FIG. 2 is a side view of the frame attached to the golf club carrying unit.
Figure 3:
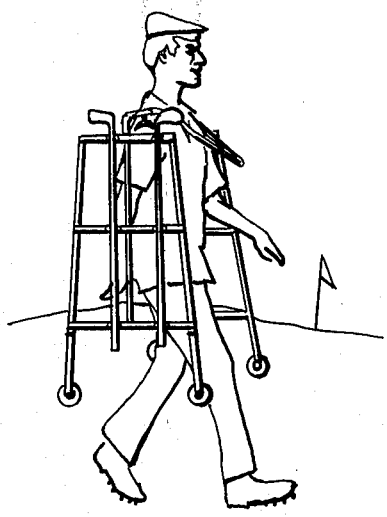
FIG. 3 is a side elevation of the frame attached to the golf club carrying unit as it is supported upon the shoulders of the user.

The length of vertical members 21 and 22 should be sufficient to accomodate the golf club carrying unit generally designed by reference numeral 70, so that vertical members 21 and 22 can be bolted or releasably secured by any conventional means to cross members 65, 66 and 67 of unit 70 at three locations, shown in FIG. 2 as 61, 62 and 63.

As shown in FIG. 2, upright support members 71 and 72 are hollow and telescopically engage tubular shafts 73 and 74 by means of set screws 75 and 76 or any other conventional means for telescopic engagement so that the overall height of unit 70 can be adjusted to the height of the user.

When the frame is supported by the user's shoulders, the wheels 81 and 82 should be off the ground by at least several inches. Or in the alternative, the unit 70 when attached to the frame 20 may be pulled or pushed by wheeling it along the ground when frame 20 is not supported on the golfer's shoulders.

Conventional spring clamps, not shown in detail, but collectively referred to as 90 in FIG. 2, which are connected to cross members 65, 66 and 67 hold the golf clubs in place by grasping the club 95 lengthwise. Extra clamps, not shown, may be used to hold balls and miscellaneous items.

Furthermore, handles 51 and 52 as shown in FIG. 1 may be mounted on vertical members 21 and 22 for grasping the frame for balancing, or for support for golfers having physical handicaps.

It is important that the collar 40 be at least 10 to 12 inches from the chest to provide the necessary balance while walking to compensate for shifts in weight and directional force. The collar 40 can be grasped with either hand while walking to facilitate balance. The user can also readily grasp the collar 40 with one or both hands while putting on or taking off the frame 20 from his shoulders.

The frame 20 may be of any suitable material known to the prior art but is preferably made of aluminum or some other light weight metal.

I claim:

1. A golf club support system adaptable for resting upon the shoulders of a golfer, wherein the weight of the golf clubs is distributed throughout said system, and said system is pivotable freely relative to the golfer, comprising:

a plurality of semi-circular platform supports, which rest on the shoulders of the golfer, a plurality of swivels, each of which is pivotally attached to each said semi-circular support, whereby each said support will pivot freely in a vertical and horizontal direction, a plurality of horizontal members substantially parallel to the golfer's shoulders, each said horizontal member secured to each said swivel, a plurality of lateral members substantially perpendicular to the width of the shoulders and angled outward from the golfer's chest, each said lateral member substantially perpendicular to each said horizontal member, a plurality of vertical members projecting outward from the chest that terminate in a substantially v-shaped collar to enable the golfer to balance said support system, each said vertical member substantially perpendicular to each said lateral member, a plurality of legs parallel on either side of the golfer's body, and substantially parallel to each other, each said leg perpendicular to each said horizontal member, and a golf club carrying means releasably secured to each said leg whereby golf clubs can be transported by said system when said means is secured to each said leg and said platform supports rest on the shoulders of the golfer.

2. The structure set forth in claim 2 above, wherein: said golf club carrying means comprises:

a plurality of cross members releasably secured to each said leg, each said cross member perpendicular to each said leg, a plurality of upright hollow support members, each said upright support member substantially perpendicular to each said cross member, a plurality of tubular shafts, each said shaft telescopically engaged by each said upright hollow support member to enable said golf club carrying means to be adjusted to the height of the golfer, and a plurality of means for holding the golf clubs in place at a plurality of locations along the length of the shaft of each golf club.

3. The structure set forth in claim 2 above, wherein: said plurality of means for holding the golf clubs in place is a plurality of spring clamps, each said clamp secured to each said cross member.

* * * * *